US008454255B2

(12) United States Patent
Jones et al.

(10) Patent No.: US 8,454,255 B2
(45) Date of Patent: Jun. 4, 2013

(54) REUSABLE PRINTING CARRIER ASSEMBLY AND METHOD OF MAKING AND OPERATING THE ASSEMBLY

(76) Inventors: Bethany Jones, Vienna, VA (US); Joseph J. Khoriaty, Potomac, MD (US)

( * ) Notice: Subject to any disclaimer, the term of this patent is extended or adjusted under 35 U.S.C. 154(b) by 1311 days.

(21) Appl. No.: 12/219,940

(22) Filed: Jul. 30, 2008

(65) Prior Publication Data

US 2010/0028538 A1 Feb. 4, 2010

(51) Int. Cl.
*B41J 13/00* (2006.01)

(52) U.S. Cl.
USPC ..... 400/578

(58) Field of Classification Search
USPC ..... 400/578
See application file for complete search history.

(56) References Cited

U.S. PATENT DOCUMENTS

| | | | | | |
|---|---|---|---|---|---|
| 3,820,447 | A | * | 6/1974 | Gendron et al. | 493/188 |
| 4,159,586 | A | | 7/1979 | Blum | |
| 4,790,475 | A | * | 12/1988 | Griffin | 229/69 |
| 4,938,414 | A | | 7/1990 | Lippert | |
| 5,007,663 | A | | 4/1991 | Moran | |
| 5,048,987 | A | * | 9/1991 | Golden | 400/613.1 |
| 5,083,979 | A | | 1/1992 | Burt | |
| 5,316,344 | A | | 5/1994 | Popat et al. | |
| 5,833,274 | A | | 11/1998 | Schmidt | |
| 6,559,970 | B1 | | 5/2003 | Yamamoto et al. | |
| 2004/0150218 | A1 | | 8/2004 | Wasko | |

* cited by examiner

*Primary Examiner* — Daniel Hess
*Assistant Examiner* — David Tardif
(74) *Attorney, Agent, or Firm* — Doster Greene, LLC

(57) ABSTRACT

A device for retaining a print medium during printing according to various exemplary embodiments can include a print medium protector pocket having a front sheet, a back sheet, and an opening. The pocket may be adapted to receive therein through the opening a print medium. A plurality of retaining mechanisms may be cut into the back sheet for releasably attaching the print medium and holding the print medium relative to the back sheet during a printing operation.

2 Claims, 8 Drawing Sheets

FIG. 5A
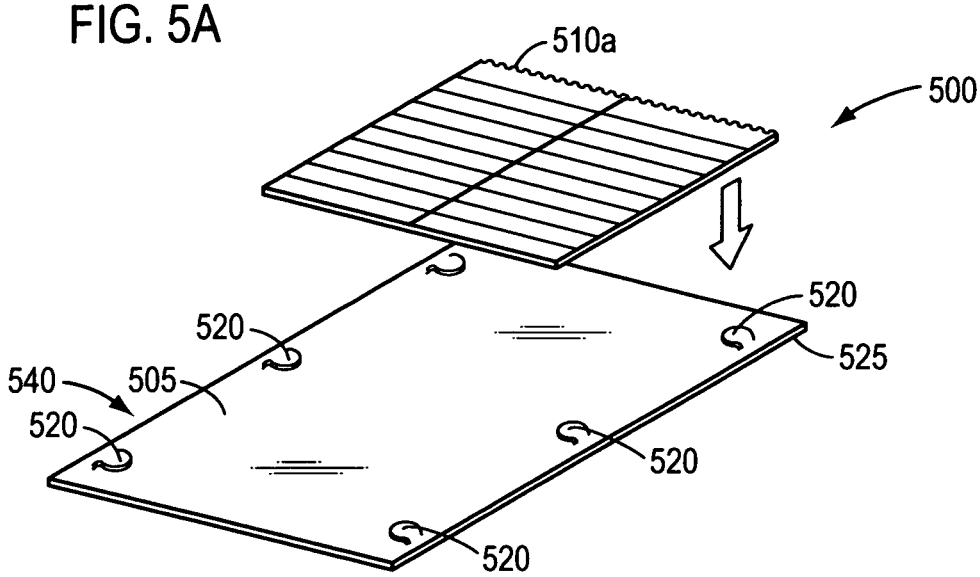
FIG. 6A
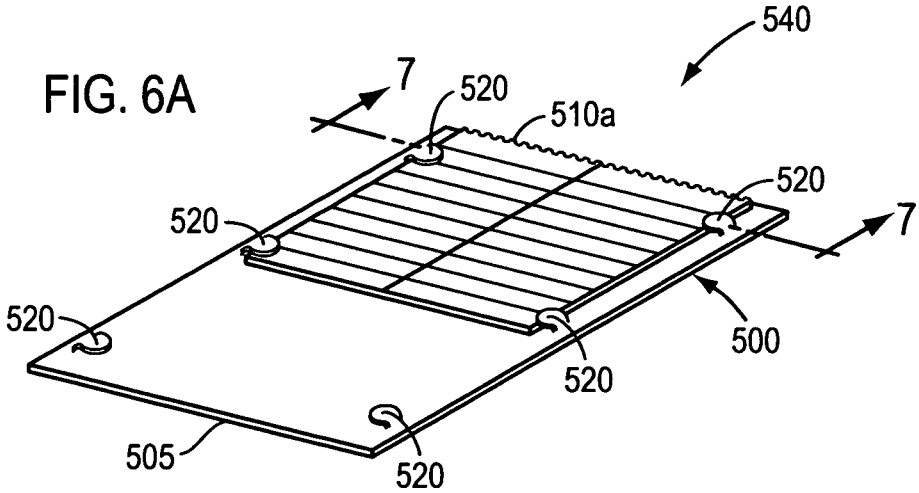
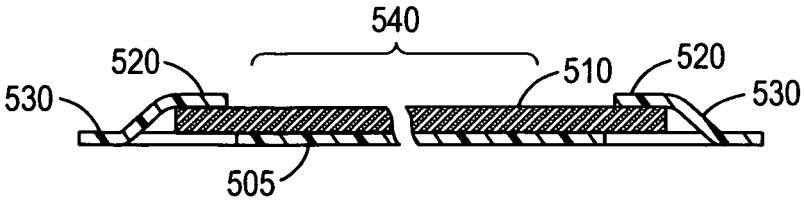
FIG. 7

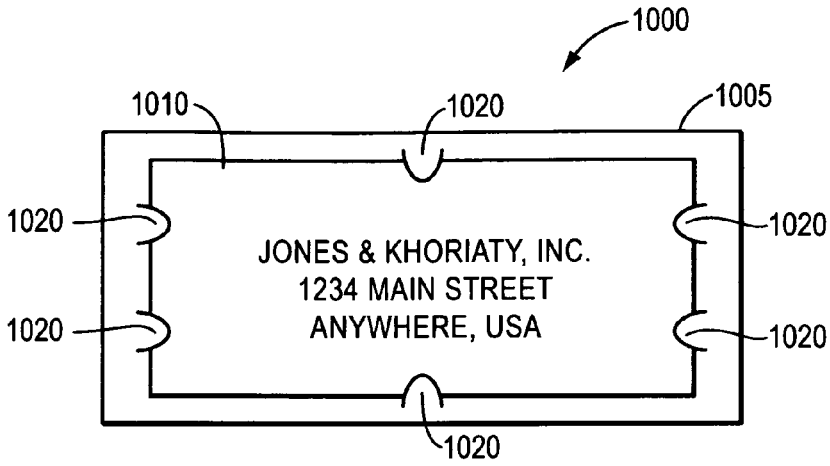
FIG. 10
FIG. 11
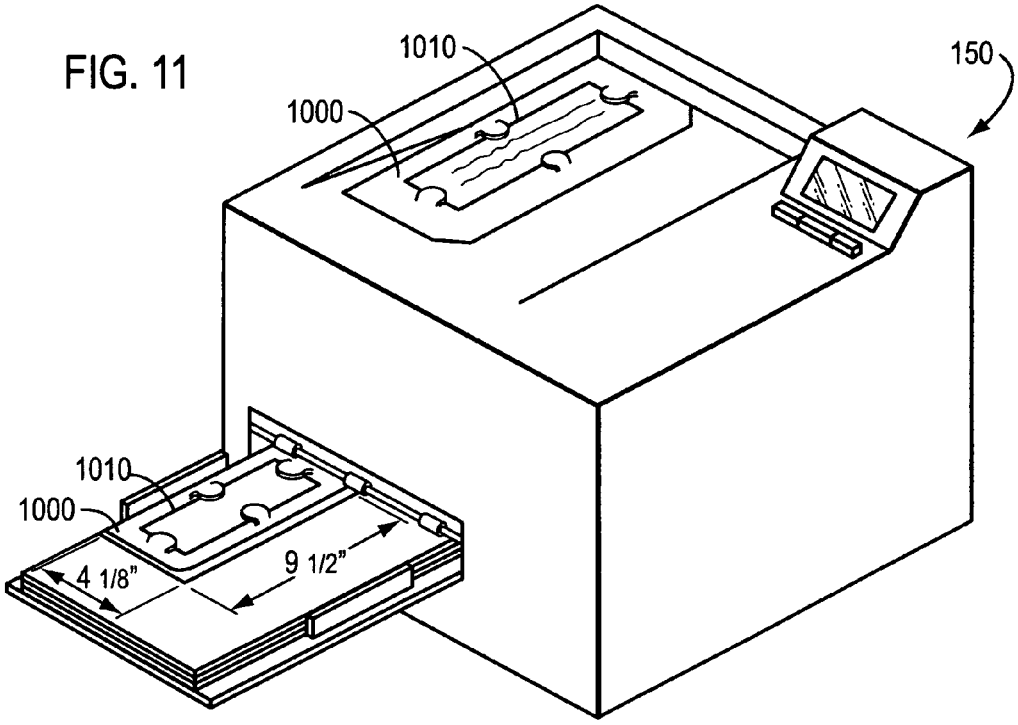

REUSABLE PRINTING CARRIER ASSEMBLY AND METHOD OF MAKING AND OPERATING THE ASSEMBLY

FIELD

The present teachings relate to devices and methods for constructing a reusable carrier assembly that is capable of retaining and aligning print media having a variety of shapes and sizes, such as, for example, a piece of paper or cardstock, such as, for example, a plurality of labels such that the plurality of labels can be fed into and printed on by a printer without jamming the printer. As an example, the present teachings is applicable to a carrier assembly having a protective compartment for receiving and retaining a print medium such that a select portion of the print medium is printed thereon, while the remaining portion is covered and protected from soiling during the printing process. Another example is a substantially flat platform for retaining a non-conventional shaped and sized print medium in any position relative to the platform such that the print medium can be fed through a printer using conventional print settings or user customizable print settings.

INTRODUCTION

Labels are common office supplies used to individually identify packages or other items to be mailed, shipped, stored or filed, by, for example, the name and address of the addresser and the addressee, the corresponding file number, a related invoice number or any other identification scheme. In order to affix the identification information to various surface areas, labels are manufactured and sold as common commodities in office supplies stores in a variety of sizes and types, such as, for example, mailing labels, return address labels, identification labels, binder labels, postal labels, special use labels and oversized labels.

With the recent development in office software, it is often desirable to use a computer printer to print the identification information on the labels. Labels used in printing devices are typically affixed to a backing and arranged in a predetermined layout. When a user desires to print labels in a printing device, he or she must use software that recognizes the labels. Currently known software programs for label printing, such as Avery Label Pro® and 3M Post-It® software, require that the user identify such things as the brand of labels, the layout of the labels, and which labels within that layout are available for printing. From this information, the software is then able to determine the size and location of the available labels on the backing before printing begins.

For a user, determining and entering this information can be a time consuming task. Also, if the user incorrectly determines or incorrectly enters a parameter, then an error will likely occur during printing of the information on a label, such as printing on the backing instead of the label or partially printing onto another label. Such errors not only waste labels but also user time.

Preset layouts and software are also available to generate forms. Forms used in printing devices typically include one or more predetermined areas for printing text and/or images. For example, forms such as award certificates or greeting cards include blank areas for information such as the name of the person, title of the award, a greeting or message. Similar to the label layout, when a person desires to print such a form, he or she must use software that recognizes the form. Likewise, if the user incorrectly enters the parameters, wasteful errors can also occur.

Another common use of printing software is that, in some cases, rather than relying upon his or her poor or illegible penmanship to write a message or text, a user may desire to use the printer and take advantage of the multitude of beautiful fonts provided by the computer software to neatly print text or an image upon a non-conventional sized cardstock or piece of paper. Unfortunately, the non-conventional cardstock or piece or paper may not be designed to be compatible with the conventional preset card layout or preset form layout and its corresponding software, because most conventional preset layouts require a specific orientation for correctly aligned printing. In comparison to the preset layouts, the non-conventional cardstock or piece of paper may vary in orientation and/or size.

In addition, labels are typically sold in a package containing individual sheets of multiple adhesive labels arranged to define a preset layout of rows and columns. When a user desires to print only a single label, a limited number of labels, special-sized labels, or a custom design label, most current label printing software programs are limited to feeding the entire sheet of labels through the printer for printing the labels using instructions and the preset layouts according to the existing software. For example, currently, there are few options available for printing, for example, a single-use address label for an oversized mailing envelope. One option is feeding labels from a roll through a printer, which requires the use of a track feeder, which typically does not apply to office situations. Another option is printing an entire sheet of the same address and then using the printed labels as the need arises for the addressee. This option is only cost effective with an addressee to whom the addresser mails correspondence on a recurring basis.

Furthermore, as discussed above, when a user desires to print a single label included on a sheet of multiple labels, the user must feed an entire sheet of labels through the printer. In feeding an entire sheet through to print a single label, the unused labels become more soiled or stained with ink residue with each pass through the printer so that eventually they are no longer usable. The unused labels can also be soiled or stained due to skewing, which results when the sheet of labels travel in a misaligned manner through the printer. This can result in the printed information being partially typed onto the backing or another label. As mentioned above, such errors not only waste labels but also user time.

It may be desirable to provide a reusable printing carrier that affords the user the ability to print only a single label, a select number of labels or a custom design label. It may also be desirable to provide a carrier that protects and prevents any unused labels from being soiled, stained, or damaged when fed through a printer to print only a select number of labels. It may also be desirable to provide a reusable printing carrier that is capable of holding and retaining any sized or shaped print medium, such as a paper or cardstock, in various orientations, such as, for example, horizontally, vertically, or diagonally, during printing.

SUMMARY

The present invention may satisfy one or more of the above-mentioned desirable features. Other features and/or advantages may become apparent from the description which follows.

A device for retaining a print medium during printing according to various exemplary embodiments can include a print medium protector pocket having a front sheet, a back sheet, and an opening. The pocket may be adapted to receive therein through the opening a print medium. A plurality of retaining mechanisms may be cut into the back sheet for releasably attaching the print medium and holding the print medium relative to the back sheet during a printing operation.

A method of printing upon a print medium according to various embodiments can include providing a print medium protector pocket having a front sheet, a back sheet, and an opening; providing a plurality of retaining mechanisms cut into the back sheet; inserting a print medium into the pocket through the opening; releasably attaching the print medium to the back sheet such that the plurality of retaining mechanisms hold the print medium relative to the back sheet during a printing operation; passing the pocket including the print medium inserted therein through a printer; and selectively printing on an exposed portion of the print medium accessible through a window provided within the front sheet while protecting a covered portion of the print medium with the front sheet during printing.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The skilled artisan will understand that the drawings described below are for illustrative purposes only. The drawings are not intended to limit the scope of the present teachings in any way.

FIG. 5A is a perspective view of another exemplary embodiment of a carrier assembly in accordance with the present teachings prior to releasably attaching a print medium thereto;

FIG. 6A is a perspective view of the carrier assembly shown in FIG. 5A with the print medium partially overlying and supported by the carrier assembly;

FIG. 7 is a cross-sectional view of the carrier assembly shown in FIG. 6A taken along line 7-7 of FIG. 6A;

FIG. 10 is a perspective view of another exemplary embodiment of a carrier assembly in accordance with the present teachings with a print medium attached thereto; and FIG. 11 is a perspective view of the carrier assembly shown in FIG. 10 with the print medium attached thereto illustrating a printer printing upon the print medium.

DETAILED DESCRIPTION OF VARIOUS EMBODIMENTS

Figure 1:
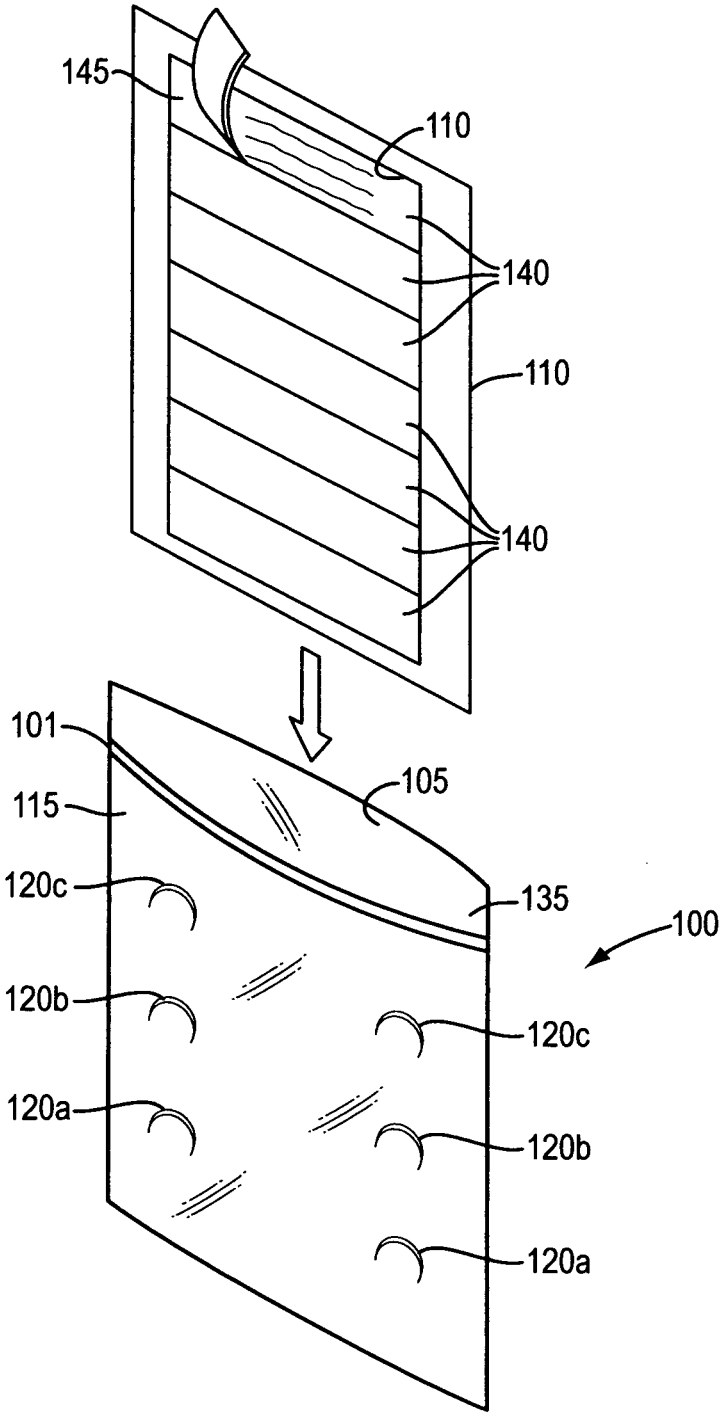
FIG. 1 is a perspective view of an exemplary embodiment of a carrier assembly in accordance with the present teachings prior to the insertion of a print medium.

Reference will now be made to various embodiments, examples of which are illustrated in the accompanying drawings. However, these various exemplary embodiments are not intended to limit the disclosure. On the contrary, the disclosure is intended to cover alternatives, modifications, and equivalents.

Throughout the application, description of various embodiments may use "comprising" language, however, it will be understood by one of skill in the art, that in some specific instances, an embodiment can alternatively be described using the language "consisting essentially of" or "consisting of."

For purposes of better understanding the present teachings and in no way limiting the scope of the teachings, it will be clear to one of skill in the art that the use of the singular includes the plural unless specifically stated otherwise. Therefore, the terms "a," "an" and "at least one" are used interchangeably in this application.

Unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained. In some instances, "about" can be understood to mean a given value ±5%.

Various embodiments of the present teachings relate to a reusable carrier assembly which supports a print medium, such as, for example, one or more labels, in a fixed position relative to the carrier assembly during a feeding and printing process in a printer. The reusable carrier assembly is suited for any type or size of adhesive labels, name tags, stickers or other cardstock or sheets of paper in which text, logos or indicia can be printed directly on the print medium.

Various embodiments of the reusable carrier assembly described herein afford the user the ability to print a single label, a select number of labels or a custom design label. Various embodiments of the reusable carrier assembly protect and prevent any unused labels from being soiled, stained, or damaged when being fed through a printer to print only a select number of labels. In various embodiments, the operation of the device may be relatively simple and robust, and may enable label preparation or document printing without using conventional preset layouts and software. In some embodiments, the operation of the device enables non-conventional sized label preparation or document printing by securely attaching the label or document onto the carrier such that it will be accommodated by a standard computer printer employing the conventional preset layout. These embodiments may permit usage by users with minimal secretarial or computer skills.

Various embodiments provide a reusable printing carrier that is capable of holding and retaining any sized or shaped printing medium, such as a paper or cardstock, in various orientations, such as, for example, horizontally, vertically, or diagonally, during printing. Thus, in various embodiments, printing of a wide variety of different kinds of labels and documents may be accomplished using the same or substantially the same device because the position and number of retaining tabs can be designed to hold virtually an unlimited number of specific shapes and sizes of labels and/or pieces of papers.

An exemplary embodiment of a reusable carrier assembly 100 that can be used according to the present teachings is illustrated in FIG. 1. The construction and printing processes for the carrier assembly 100 will be described later. The carrier assembly 100 may include a support sheet 105 and an external cover 115 joined to form a pocket 101 having an opening 135, shown, for example, at the top. Opening 135 may be constructed at any location within the external cover 115, as described further below.

Figure 2:
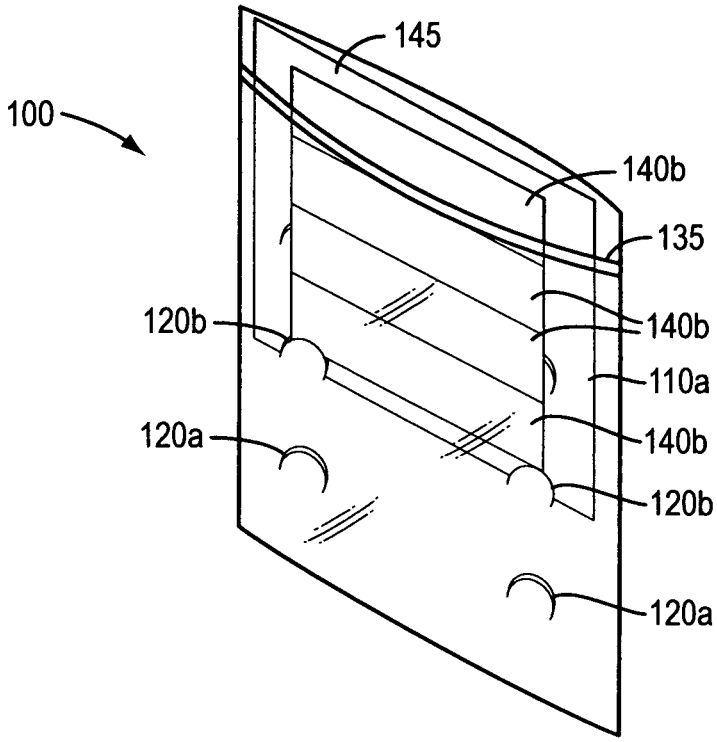
FIG. 2 is a perspective view of the carrier assembly shown in FIG. 1 with a print medium inserted therein.
Figure 3:
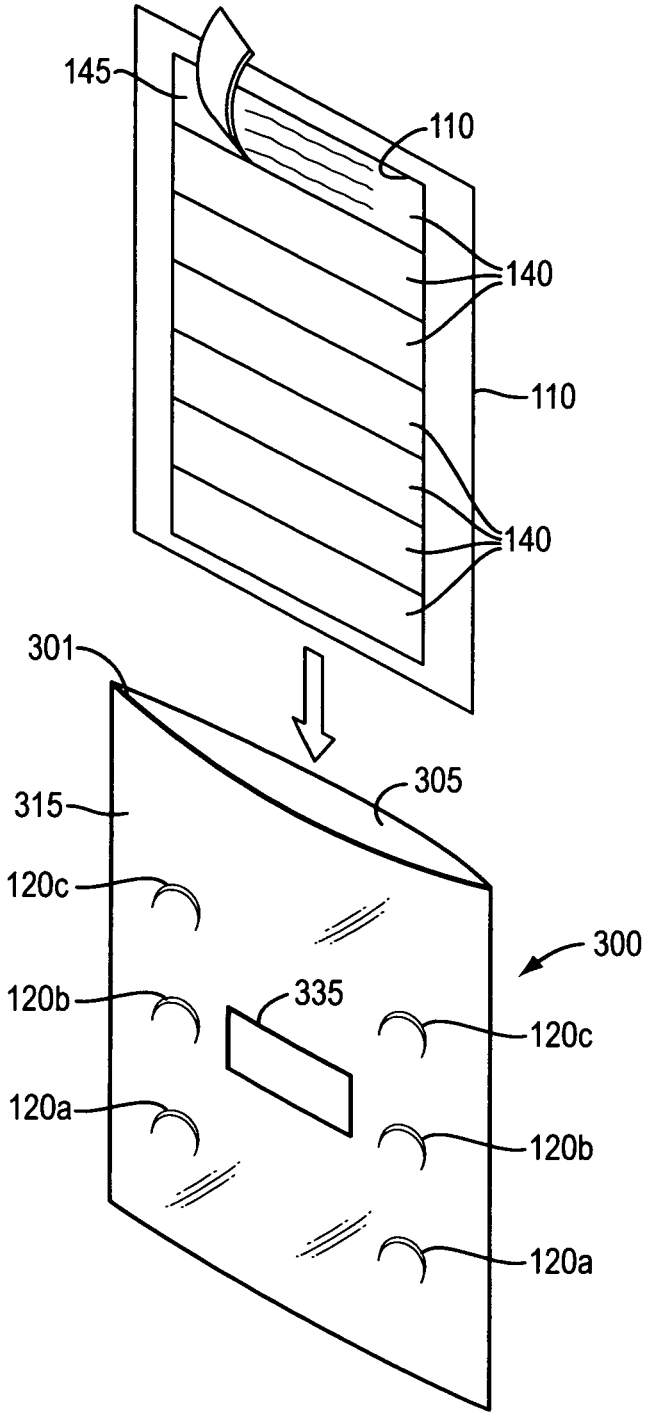
FIG. 3 is a perspective view of another exemplary embodiment of a carrier assembly in accordance with the present teaching prior to the insertion of a print medium.

As shown in FIGS. 1 and 2, the external cover 115 may be integrally formed with the support sheet 105 to form the pocket 101 for inserting any print medium, such as, for example, a sheet of adhesive labels 110. The discussion may often refer to and the figures may illustrate a sheet of adhesive labels. Those having skill in the art would understand, however, that other print medium may be employed. In FIGS. 1-3, the sheet of adhesive labels 110 can be inserted into pocket 101 through the open top. In various embodiments, the external cover 115 can also be formed as a unit separate from the support sheet 105 if desired, and then subsequently joined with the support sheet 105 to form the pocket 101. The support sheet 105 and the external cover 115 may be constructed of a transparent plastic sheet or other resilient material having sufficient strength for repeated insertion and removal from a printer.

The height of the external cover 115 in the exemplary embodiment of FIG. 1 is substantially shorter than the height of the support sheet 105 thus to form opening 135 for exposing only a select quantity of labels to be printed while providing a protective shield cover for the remaining labels during printing (FIGS. 1-3). In the exemplary embodiments shown in FIGS. 1 and 2, the opening 135, which functions to exposes only a select number of labels or a select portion of a document for printing, is positioned at the top of the external cover 115, thus integrally with the pocket 101.

In various embodiments, as shown for example in FIG. 3, the carrier assembly 300 may be designed such that the height of the external cover 315 may be substantially the same as the support sheet 305 joining to form a pocket 301 for inserting the sheet of labels 110 or another type of document. Opening 335 may be constructed at any location within the external cover 315. Although the opening 135 shown in the exemplary embodiments in FIGS. 1 and 2 extending horizontally across the external cover 115, the opening may take any desired shape. As shown for example in FIG. 3, the opening 335 may be configured having a rectangular shape within the external cover 315. In various embodiments, the opening 335 within external cover 115 may be configured defining a shape other than rectangular, such as, for example, extending diagonally across the external cover 115 or defining square, a triangle, oval, circle, semi-circle, etc. In various embodiments, the external cover 115 may be configured having a plurality of openings formed therein having any of the shapes referenced above to expose a select number of labels or a select portion of the document, while providing a protective shield for other labels or other portions of the document.

In some embodiments, the carrier assembly can be slightly larger than 8-½ inches by 11 inches, so long as it is capable of fully receiving the sheet of adhesive labels. For example, in some embodiments, the carrier assembly can be approximately 8-¾ inches by 11-¼ inches. As shown in the exemplary embodiment in FIGS. 1-3, the sheet of adhesive labels 110 can be smaller than the support sheet 105, and the support sheet 105 can include a plurality of centering tabs or cuts 120 for supporting the sheet of adhesive labels 110 and holding it in a fixed printing location relative to the support sheet 105. The sheet of adhesive labels 110 can be centered relative to the support sheet 105, and as a result, the sheet of adhesive labels 110 can also be centered or properly aligned during a feeding and printing operation. However, the sheet of adhesive labels can be positioned anywhere on the support sheet 105 by placing the tabs 120 at the appropriate locations, as shown in the various tab arrangements in FIGS. 5, 8, and 10. The tabs 120 may also be shaped rectangularly, arcuately, triangularly, or any other appropriate shape. The tabs can be positioned on the support sheet 105 to form any geometric configurations. The tab arrangement of a single carrier assembly may be configured to include numerous tabs arranged to securely hold various documents having different shapes, such as, for example, triangular, square, rectangular, circular, oval, semi-circular, star, diamond, and pentagon, etc.

When using the carrier assembly 100, the user inserts the sheet of labels 110 into the pocket 101 (FIG. 1) such that at least one or more edges of the sheet of labels 110 are retained under one or more tabs 120, as shown in FIG. 2. The carrier assembly 100 may carry any printing medium or document, such as, for example, any type or size of label, return address labels, mailing labels, file folder labels, oversized labels, name tags, logo labels, bookmarks, greeting cards, or gift cards. The user inserts the sheet of labels 110 into the pocket of the carrier assembly 100 whereby the external cover 115 can permit the labels to be viewed therethrough. The external cover 115 can either be transparent or have an additional window or cut-out (not shown) to allow the labels to be viewed therethrough to assist with the proper positioning of the labels.

Figure 4:
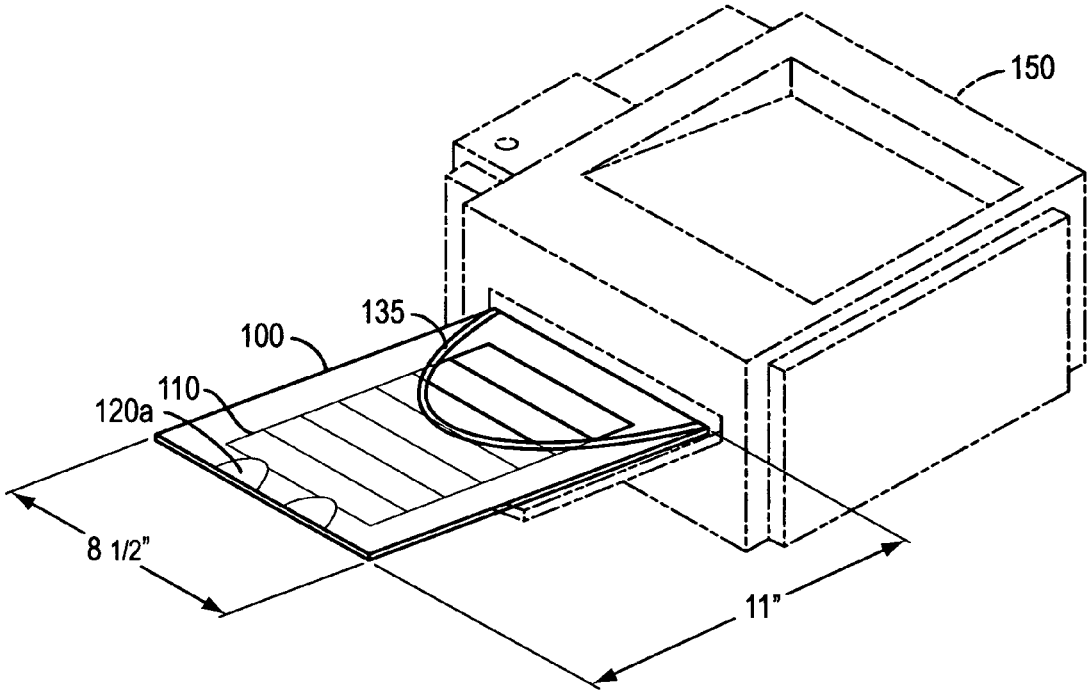
FIG. 4 is a perspective view of the carrier assembly shown in FIG. 1 with the print medium inserted therein illustrating a printer printing upon an exposed portion of the print medium.

The sheet of adhesive labels 110 illustrated in the exemplary embodiment of FIG. 1 is an 8-½ inches by 11 inches sheet including seven adhesive labels 140. As mentioned above, the carrier assembly is configured to be substantially the same size as 8-½ inches by 11 inches; however, just slightly larger to accommodate the sheet of labels. The user may insert the 8-½ inches by 11 inches sheet of FIG. 1 into the carrier assembly 100 retaining the full sheet of labels 110 under lowest level of tabs 120*a*. The sheet of labels 110 is positioned within the carrier assembly 100 such that only the top three labels are exposed for printing thereon (FIG. 4). The carrier assembly 100, together with the sheet of labels 110, can be inserted into a printer 150, such as that shown in FIG. 4 to print on a select number of labels, for example, the top three labels. To print the selected labels or selected portion of a document, the user may select a preformatted label or document setting using existing software or print a special or custom design. As shown in FIG. 4, during printing, the external cover 115 shields and protects the remaining four unused labels. After printing the top three labels, the user may peel off the printed labels from the backing 145 of the sheet of adhesive labels and apply each label to the desired surface.

In comparison to FIG. 1, in FIG. 2, after the initial printing in FIG. 1, the user may wish to use the remaining four labels. The user may tear off the empty backing 145 along micro-perforated lines such that the sheet of labels 110*a* now contains only the four unused labels 140*b*, as shown in FIG. 2. The user may now reinsert the sheet of labels 110*a* into the carrier assembly 100 so that only a select number of labels are exposed for printing while providing a protective shield cover for the remaining labels during printing. In comparison to FIG. 1, the user may adjust the sheet of labels 110*a* upward by retaining the bottom edge of the sheet of labels using tab 120*b* such that only a select number of labels are positioned within opening 135 and exposed for printing thereon. Further details of the tab assembly will be described in reference to FIGS. 5A, 6A, and 7.

Figure 5B:
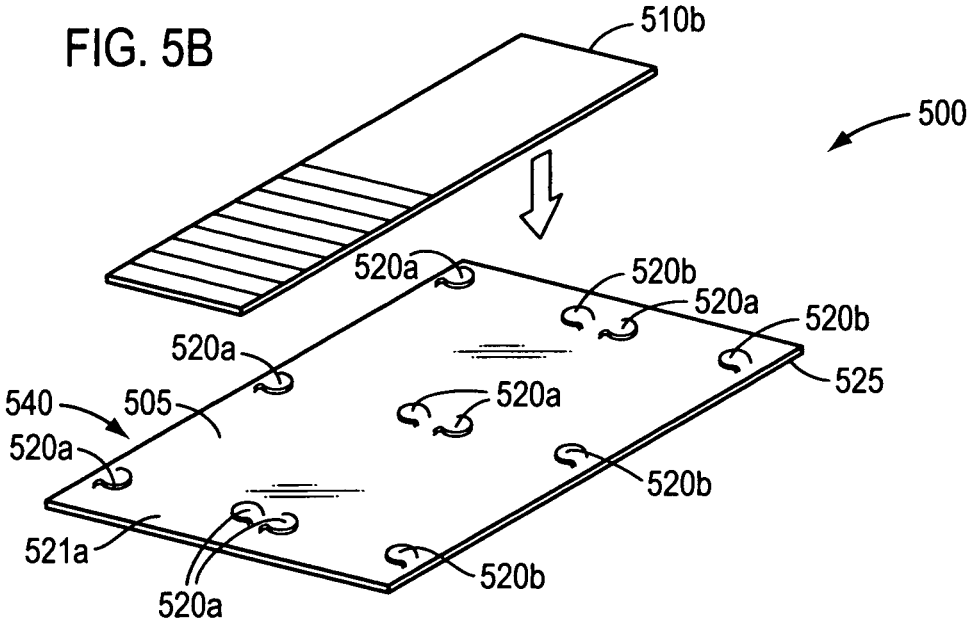
FIG. 5B is a perspective view of another exemplary embodiment of a carrier assembly in accordance with the present teachings prior to releasably attaching a print medium thereto.
Figure 8:
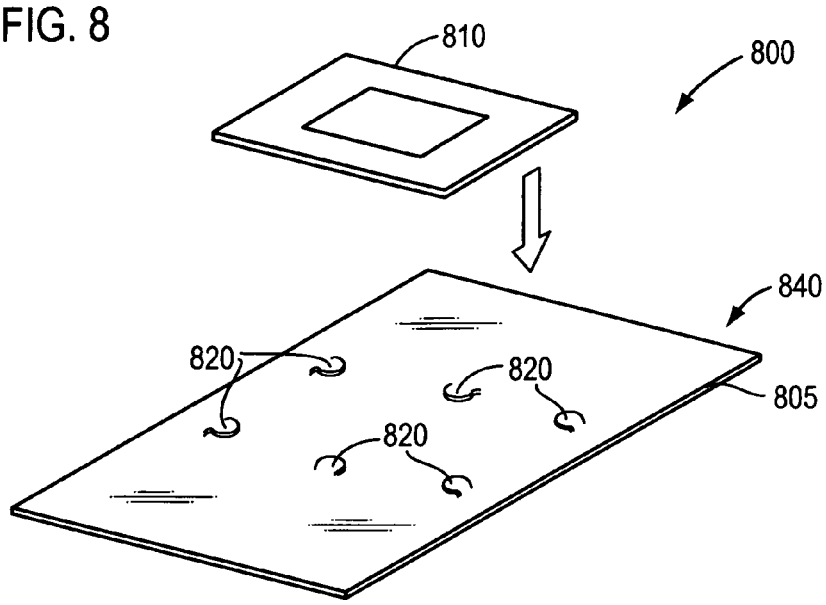
FIG. 8 is a perspective view of another exemplary embodiment of a carrier assembly in accordance with the present teachings prior to releasably attaching a print medium thereto.
Figure 9:
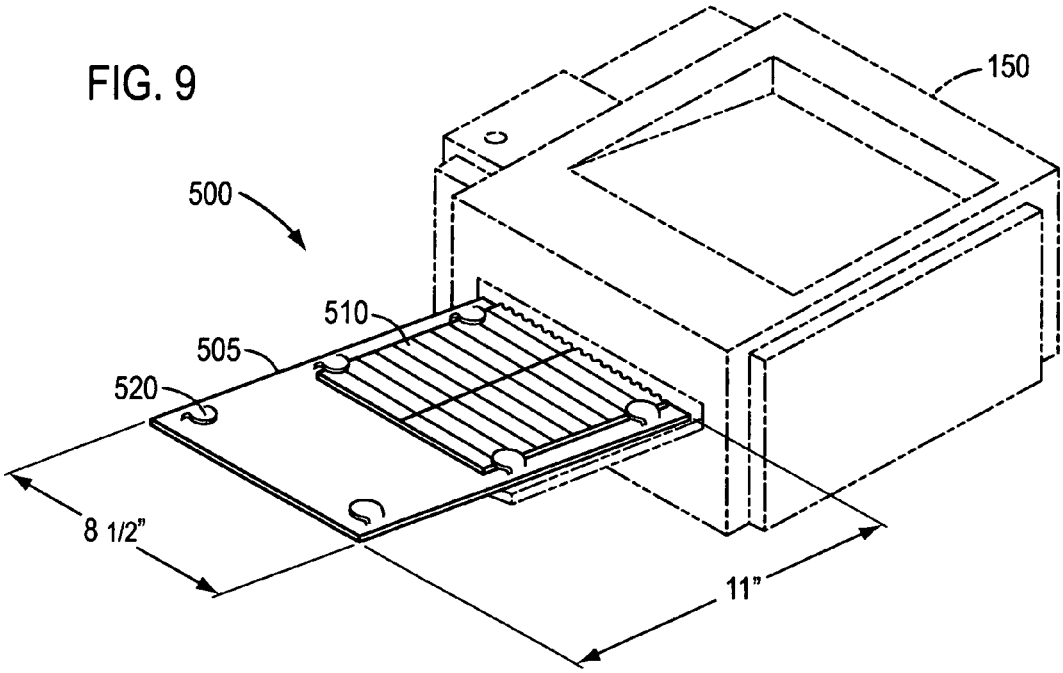
FIG. 9 is a perspective view of the carrier assembly shown in FIG. 6A with the print medium releasably attached thereto illustrating a printer printing upon a previously-used print medium.

In various embodiments, as shown in FIGS. 5-7, the carrier assembly may be configured without a pocket to shield the print medium, such as a single name tag, a sheet of Pendaflex® file labels, or a narrow strip of Pendaflex® file labels, as long as it is reusable for retaining the print medium during repeated insertion and removal from a printer, as shown in FIG. 9. In lieu of the pocket 101 and 301 as shown in FIGS. 1-3, in some exemplary embodiments, the carrier assembly 500 may include only a support sheet 505 and a plurality of retaining tabs or cuts 520 for supporting, for example, a sheet of Pendaflex® file labels 510*a* (FIGS. 5A and 6A) or a narrow strip of Pendaflex® file labels 510*b* (FIG. 5B). The carrier assembly in FIGS. 5-8 is capable of retaining a document or sheet of labels 510 with tabs 520 in order to properly position and align a document of any shape or size in any direction during printing. The embodiment in FIG. 9 illustrates the carrier assembly of FIGS. 5A and 6A being fed in a portrait direction into a printer. The carrier assembly can also be fed into the printer such that the printer prints upon the print medium in the landscape direction. Using the retaining tabs 520, for example in FIGS. 5-7, any shaped or sized document or sheet of labels can be positioned in multiple locations on the carrier assembly to facilitate proper alignment and orientation during printing. Thus, this arrangement, similar to FIGS. 1-3, assists to enhance the feeding efficient and prevent skewed feeding, especially, for use with non-conventional shaped documents.

In the illustrated embodiment of FIGS. 5A, 6A and 7, the semi-circular shaped tabs 520 of the tab assembly 540 are cut into the base 525 of the support sheet 505 and are positioned at the peripheral corners of the base 525. Additional tabs 520 are positioned in between the corner tabs 520 along the vertical sides of the support sheet 505. Similar to FIGS. 1-3, the tabs 520 in FIGS. 5-7 may also be shaped rectangularly, arcuately, triangularly, or any other appropriate shape. The tabs can be positioned on the support sheet 505 to form any geometric configurations. In FIG. 7, the tabs 520 have base portions 530 coupled to the base 525 of the support sheet 505. The base portions 530 of the tabs 520 are separated along the width of the support sheet 510 by a distance which corresponds to the width of the sheet of Pendaflex® labels 510 so that the sheet of labels can be properly secured (FIG. 6A).

When using this embodiment with file insert labels such as Pendaflex®, professional computer-generated labels can be printed. Typically, with file insert labels that are connected via perforations, the sheet of labels can initially be inserted into the printer, properly aligned and printed upon using conventional software templates. However, once the user separates or tears off one or more of the initially printed file insert labels from the sheet of labels, the remaining sheet of file insert labels no longer can be reinserted and properly aligned using the conventional software templates. When the sheet of labels is torn, the size of the remaining sheet of labels becomes non-conventional and no longer corresponds to a standard software printing template. Due to the resulting non-conventional size and the perforated edge of the remaining sheet of file insert labels, jamming of the printer frequently occurs. After the initial printing, oftentimes, the remaining file insert labels are either discarded or hand written upon, which can be difficult to read and aesthetically unpleasing. These embodiments of the present teachings of the carrier assembly, as shown in FIGS. 5A and 6A enables the user to attach the perforated sheet of file insert labels 510*a*, properly align the sheet at any position and reinsert the sheet for printing upon a select number or the remaining sheet of file insert labels, In the case of this illustrated embodiment, the base 525 of the tabs 520 are separated approximately 8-½ inches along the width of the support sheet 505. In this embodiment of FIG. 5A, the corner tabs 520 are separated length-wise slightly less than 11 inches. For various-sized sheets of labels 510, the tabs 520 may be located further inboard along the edge of the sheet of labels 510 (FIGS. 5B, 8, and 10). As shown in FIG. 6A, the sheet of labels 510 partially overlies the support sheet 505 and is positioned underneath some of the tabs 520 such that the sheet of labels 510 is supported and held in a fixed print location relative to the support sheet 505. The positioning of the sheet of labels 510 relative to the support sheet 505 and tabs 520 can be seen in the cross-sectional view of FIG. 7 taken through the carrier assembly 500 along line-7—7 of FIG. 6A. Likewise, during use, the user may use the configuration of the tab assembly 540 to retain the sheet of labels 510 in a fixed printing location relative to the support sheet 510.

Figure 6B:
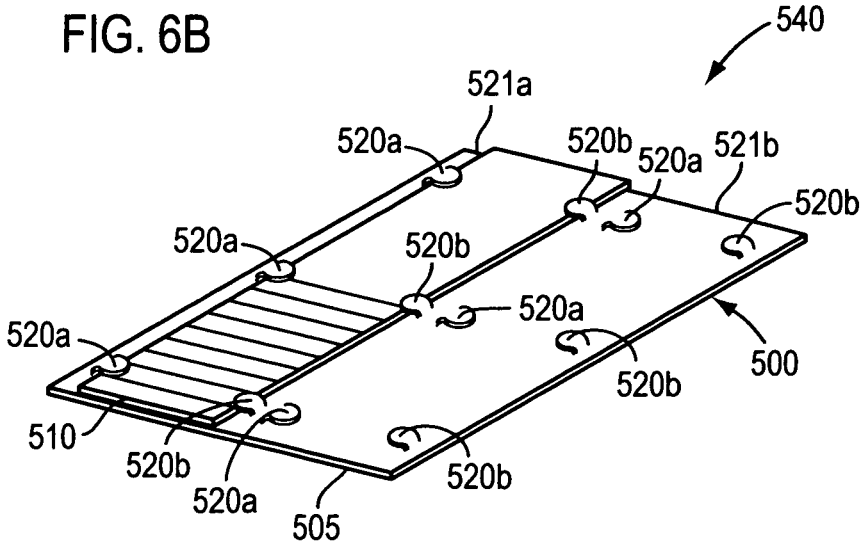
FIG. 6B is a perspective view of the carrier assembly shown in FIG. 5B with the print medium partially overlying and supported by the carrier assembly.

In the embodiment in FIG. 5B, the tab arrangement 540 forms two columns 521*a*, 521*b* outlined by parallel extending tabs cut into the base 525 of the support sheet 520*b*. Each column 521*a*, 521*b* includes three pairs of opposing tabs 520*a*, 520*b*. Opposing tabs 520*a*, 520 b are laterally offset, in this example, a predetermined distance such that the narrow strip of Pendaflex® labels can be inserted into either the left column 521*a* or the right column 520*b* and held in a fixed position during printing. To configure the narrow strip of Pendaflex® labels for printing, the user may use, for example, the table format setting of a conventional software application. Depending upon the position of the table as displayed on the computer screen, the user can choose to insert the Pendaflex® labels into the left column 521*a* or the right column 521*b*. FIG. 6B illustrates the Pendaflex® labels inserted under the tabs of the left column 521*a*. The tab arrangement of the embodiment in FIGS. 5B and 6B can hold print media having a variety of shapes and sizes. For instance, the tab arrangement of FIGS. 5B and 6B can also be employed to retain the sheet of Pendaflex® labels depicted in FIGS. 5A and 6A.

In various embodiments, the tab assembly of the carrier assembly may be configured to support universal sizes and shapes, such as, for example, round, hexagon, square, or triangular on the support sheet. For example, in the exemplary embodiment of FIG. 8 of the carrier assembly 800, the tab assembly 840 may have a configuration that defines a rectangular shape. Similar to FIGS. 1-3 and 5-8, carrier assembly 800 may include a support sheet 805 and tabs 820 for retaining a document 810, without including an external cover to form a pocket, during repeated printing. The document 810 may be any cardstock, sheet of paper or sheet including one or more adhesive labels. The exemplary embodiment in FIG. 8 may retain any document for printing in a portrait or landscape direction as described with reference to FIGS. 5-7 and as shown in FIG. 9.

FIGS. 10 and 11 illustrate an alternative embodiments depicting a carrier assembly 1000 configured having the dimensions of a standard No. 10 envelope of approximately 9-½ in.×4-⅛ in. One of the advantages of this arrangement is that many existing printers and corresponding software are commonly formatted to print such standard sized envelopes.

Similar to the embodiments in FIGS. 5-9, the carrier assembly 1000 may include only a support sheet 1005 and a plurality of centering tabs or cuts 1020 for supporting the document or sheet of adhesive labels 1010. One of the advantages of this arrangement is that the device is capable of properly aligning and retaining a document or sheet of labels 1010 with tabs 1020. The carrier assembly 1010 can assist properly positioning and aligning a document of any shape or size in any direction during printing, as shown in FIG. 11. For example, the document may be a single oversized label, as shown, for example in FIG. 10. Alternatively, the carrier assembly may be manufactured similar to FIGS. 1-3 including a pocket and an external cover sheet for protecting a selected portion of the document during printing.

FIG. 11 depicts the carrier assembly having dimensions of 9-½ in.×4-⅛ in., ready to be fed into a printer and printed thereon. The document or sheet of labels 1010 is releasably attached to the carrier by a plurality of tabs 1020. Tabs 1020 maintain the integrity of the carrier assembly as it is being printed. In this configuration, the user may load the carrier assembly 1000 along with the sheet of labels 1010 into a standard size printer tray, select the preformatted envelope print settings to have indicia printed on the selected labels by the printer in a simple printing step, and then separate the tabs 1020 from the carrier assembly 1000 in a single motion.

In general, the carrier assembly and the document or sheet of labels are releasably secured together by the retaining tabs to form an overall generally flat paper assembly that has a footprint slightly larger than, or equivalent to, a standard 8-½ inches by 11 inches sheet of paper in FIGS. 1-3, 5, 6, and 8 and to be slightly larger and to resemble a standard -9½ inches by 4-⅛ inches envelope in FIG. 10. Those having skill in the art would recognize, however, that the carrier assembly can be configured having a variety of differing configurations. For example, in some embodiments, the carrier assembly may be configured to resemble and retain a legal sized 8-½ inches by 14 inches sheet of paper.

Mechanisms other than the retaining tabs may be used to temporarily secure the document or sheet of labels to the carrier assembly during printing. In some embodiments, the carrier assembly and the document may be releasably adhered together using any of a variety of materials and techniques that are known within the relevant art. In a first technique, a removable adhesive such as a hot melt removable adhesive may be used. The removable adhesive with removable backings may be applied to the carrier assembly for ease of manufacturing in either a strip or in one or more spots. After removal of the backing, the carrier assembly and the document or sheet of label may be then pressed together to adhere them. When the user separates the document or sheet of labels from the carrier assembly, the adhesive remains on the carrier, leaving the document or sheet of labels non-sticky. In a second technique, a tacky adhesive such as a pressure sensitive adhesive (PSA) is applied to the carrier assembly, and a back area of the document or sheet of labels that will contact the tacky adhesive may be treated or otherwise coated with a release material such as a thin layer of silicone so that after the carrier assembly and the document or sheet of labels are pressed together the carrier assembly may later be peeled away from the document or sheet of labels.

Various embodiments of the carrier assembly provide reusable structures and methods of use thereof. A single carrier assembly according to the present teachings can provide multiple uses. Preferably, the carrier assembly is formed from environmentally friendly materials. Such environmentally friendly materials broadly include, but are not limited to, recycled papers, plant based plastics, and earth friendly glues and adhesives. The carrier assembly can be economically formed and used in a way such that waste can be reduced and natural resources conserved. That is, reusable carrier assembly structures can be formed and kits can be formed for converting existing office supplies, such as, for example, document covers or binder pockets, to reusable carrier assemblies in accordance with the present teaching. As such, carrier assemblies may advantageously be provided that can be reused one or more times, which saves time, money, and conserves natural resources.

In various embodiments, the carrier assembly may be in the form of a consumable product, configured to be disposed after use. For example, the carrier may consist of low-grade paper products, such as those manufactured from recycled materials, that can be disposed after a single use without adversely impacting the environment.

In use, the carrier assemblies are made of material that is capable of being readily printed on using conventional printers or copier 150 having a feed tray and an output tray. The printer or copier 115 can be a personal computer (PC) printer. It can be a laser printer (which prints on high temperature resistant envelopes or other papers), or it can be an ink jet printer (which prints on ink receptive documents, cardstock, labels or other papers). It can also be operatively connected in a known manner to the Internet to access sites which allow the user to print preformatted documents or labels using commercially available products and software or custom labels, as described earlier herein. The printer or copier 115 can generally be those available today, those known in the prior art or those to be developed later.

The carrier assembly allows the document or sheet of adhesive labels to be fed from either side of the paper feed tray. That is, the carrier assembly permits the document or sheet of adhesive label to be printable in multiple directions. Thus, rendering the carrier assembly usable with several different software programs and printers, each of which may require printing in the different directions. FIGS. 4 and 9 illustrate the carrier assembly being fed in a portrait-feed direction in the printer feed tray, and FIG. 11 shows a landscape-feed orientation. To assist with the proper orientation and alignment of the print medium, the carrier assembly may include a ruler graphic printed thereon during manufacturing that corresponds with standard software programs, such as, for example, WORD® or WORDPERFECT®. Such a ruler may enable the user to visualize on the carrier assembly the same measurements of the software program that are displayed on the computer screen as the user formats the print medium for printing.

The carrier assembly can be stack loaded into the printer paper tray and used in large volume mailing applications. When fully assembled, the thickness of the carrier assembly, including the document or sheet of labels, is configured to allow the assemblies to be individually picked up and fed individually or off of a stack of same in the feed trays into the printer/copier. In some embodiments, the carrier assembly including the document or sheet of labels can be approximately three paper layers thick. The overall carrier assembly is generally flat, meaning that it is flat enough to be processed through a laser printer, photocopier, or other printing device. In some embodiments, the carrier assembly may be fed through a printer by the user employing the printer's setting for thick paper.

Pursuant to the present teachings, the retaining tabs may be cut out into the base of the carrier assembly, such that the retaining tabs do not get caught up or cause a jam to hinder printing. The retaining tabs may be configured such that they are pressed downward, flat against the document or sheet of adhesive labels during printing. In various exemplary embodiments, a carrier assembly can be printer specific such that the configuration of the retaining tabs can be selected based upon the specific printing direction and orientation of the printer. In all of the embodiments the carrier assembly is preferably fed into the printer in a direction that is compatible with the printing feed direction of the printer.

In use, the carrier assembly and the document or sheet of labels are passed through a printer or copier, and the printer or copier prints on the document or sheet of labels, as directed by the software or as instructed by the user for custom or special design. The carrier assembly and the document or sheet of labels with the desired indicia printed thereon are output into the output tray of the printer or copier for removal therefrom by the user. The user then removes the document or sheet of labels from the carrier assembly. When used to print labels, the user detaches the printed labels from the support sheet. The user either separates or peels off the strips from the adhesive backing or tears along the weakened micro-perforated lines. The document or sheet of labels may include creases, scores, die cuts, or perforations to create weakening lines at the locations where separation or folding is to take place.

Some conventional devices permit printing of removable address labels attached to another document such as a letter or carrier by directly adhering the label through the use of an adhesive to the letter or carrier during printing. An adhesive substance is often used to removably attach the label to the letter or carrier during printing, as described in U.S. Pat. No. 5,316,334 and US Patent Application Publication No. 2004/0150218. After printing, the label is peeled off and reattached to a different surface such as the corresponding mailing envelope. The repeated attaching, detaching and reattaching of the label tend to degrade the effectiveness of the adhesive of the label causing the label to barely adhere, if at all, to the final document. In contrast, various embodiments of the present teachings of the carrier assembly permit the user to selectively print on a removable label; however, the label is not adhered to the carrier assembly. Instead, the sheet of the labels is retained by the individual retaining mechanisms of the carrier assembly. Thus, the labels are printed upon without the seal of the adhesive substance being broken until the labels are applied to the desired document or article. Furthermore, the embodiments of the non-adhesive retaining mechanisms of the carrier assembly facilitate the reusability of the device. The carrier assembly can be repeatedly inserted into the printer. However, with the conventional devices that employ adhesives, the repeated heat and pressure asserted by the printer during each use will eventually melt or smear the adhesive and cause a sticky mess.

In various exemplary embodiments, such as, for example, in the exemplary embodiments of FIGS. 1-3, the external cover 115 can be flexible plastic sheet, such as, for example, a transparent/translucent plastic or polypropylene material with thicknesses of between 0.0002-0.00050 inch; for example, 0.0002 inch for economy weight, 0.00024 for standard weight, 0.00033 for heavyweight, and 0.00050 for super heavyweight. Aside from polypropylene, polyester, polyethylene and vinyl can be used. All of these materials can be used, as the above list is not an exclusive one.

In some embodiments, the external cover 115 may not be transparent (or opaque) but a solid sheet having an opening 335 (FIG. 4) through which the selected portion or selected number of labels, when in the inserted printing position, can be viewed and accessible for printing, as can be understood from FIGS. 3 and 4.

In various embodiments, such as, in the exemplary embodiments of FIGS. 1-3 including the pocket 101 and 301 and in various embodiments, such as, in FIGS. 5-8 and 10, without the pocket, the support sheet can be formed of a plastic, polypropylene, regular bond paper or heavier cardstock material. Alternatively, they can be formed with the support sheet being opaque or translucent plastic or polypropylene or some combination thereof.

Generally, any of the structures described herein can be manufactured from polypropylene, vinyl, polyester, polystyrene or any other clear or translucent film that can be formed into a carrier assembly. The welding and/or folding of the films can be accomplished by means of heat, ultrasonic, pressure or deformation. Further to the disclosures provided above, examples of possible geometries of the carrier assembly are:

(1) A transparent or opaque two-ply pocket or sleeve approximately 8-½ inches by 11 inches carrier assembly, welded at the right and left side edges and bottom, and open at the top to form the pocket or sleeve, including, for example, tabs, notches, fasteners, slots, glue, etc. for temporarily securing the document at any location within the sleeve. This embodiment may include one or more windows located at the top or other locations within the external cover of the carrier assembly. With this embodiment, the printer may print a full letter-sized document or sheet of labels (all sizes) printing across a single line at a time. This embodiment may also print smaller label sheets, such as, for example, 4×6 Avery® #5202 or Pendaflex® labels hanging file labels, printing such labels, a single label at a time. This embodiment may further be used to print No. 10 envelopes with conventional printers that typically cannot feed No. 10 envelopes. Use of this embodiment may further enable the user to print using a conventional printer with existing software a single mailing label of any size or shape, such as, for example, for printing a single mailing label for a large envelope.

(2) A transparent or opaque single sheet approximately 8-½ inches by 11 inches carrier assembly, including, for example, tabs, notches, slots, fasteners, glue, etc. for temporarily securing the document at any location along the carrier assembly. Although this embodiment does not contain a pocket, it still enables the user to perform all of the above described uses.

(3) A transparent or opaque two-ply sleeve or pocket approximately 9-½ inches by 4-⅛ inches carrier assembly having dimensions of a No. 10 envelope, welded at the right and left side edges and bottom, and open at the top to form the pocket or sleeve, including, for example, tabs, notches, slots, fasteners, glue, etc. for temporarily securing the document at any location within the sleeve. This embodiment may include one or more openings located at the top or other locations within the external cover of the carrier assembly. Likewise, this embodiment enables the user to perform all of the above described uses.

(4) A transparent or opaque single sheet approximately 9-½ inches by 4-⅛ inches carrier assembly, without a pocket but including, for example, tabs, notches, slots, fasteners, glue, etc. for temporarily securing the document at any location along the carrier assembly. Although this embodiment does not contain a pocket, it still enables the user to perform all of the above described uses.

Other embodiments of the disclosure will be apparent to those skilled in the art from consideration of the specification and practice of the teachings disclosed herein. It is intended that the specification and examples be considered as exemplary only.

What is claimed is:

1. A method of printing upon a print medium, comprising:

providing a reusable print medium protector pocket having a front sheet, a back sheet, and an opening;

providing a plurality of retaining mechanisms cut into the back sheet, the plurality of retaining mechanisms configured for temporary placement of a print medium within the pocket, the plurality of retaining mechanisms having an initial rest configuration prior to insertion of the print medium therein, wherein the plurality of retaining mechanisms is configured to resiliently deflect from the rest configuration under tension to a retention configuration during the temporary placement to facilitate maintaining and temporarily retaining the print medium in a position during the printing operation, wherein the plurality of retaining mechanisms resiliently reverts to the rest configuration for reuse upon removal of the print medium from the pocket and release of the tension, and the plurality of flexible retaining mechanisms are positioned relative to each other within the pocket to enable the print medium to be selectively placed within the pocket;

inserting the print medium into the pocket through the opening;

releasably attaching the print medium to the back sheet such that the plurality of retaining mechanisms hold the print medium relative to the back sheet during the printing operation;

passing the pocket including the print medium inserted therein through a printer; and selectively printing on an exposed portion of the print medium accessible through a window provided within the front sheet while protecting a covered portion of the print medium with the front sheet during printing.

2. A method of printing upon a print medium, comprising:

providing a reusable carrier assembly having a platform and formed of a single sheet of material;

providing a plurality of retaining mechanisms cut into the platform for releasably attaching a print medium and holding the print medium relative to the platform during a printing operation, wherein the plurality of retaining mechanisms is arranged to hold print media having a variety of non-conventional shapes and sizes, which do not correspond to a preformatted template of a computer software printing application, the plurality of retaining mechanisms configured for temporary placement of the print medium onto the carrier assembly, the plurality of retaining mechanisms having an initial rest configuration prior to attachment of the print medium thereon, wherein the plurality of retaining mechanisms is configured to resiliently deflect from the rest configuration under tension to a retention configuration during the temporary placement to facilitate maintaining and temporarily retaining the print medium during the printing operation, wherein the plurality of retaining mechanisms resiliently reverts to the rest configuration for reuse upon removal of the print medium from the carrier assembly and release of the tension, and the plurality of flexible retaining mechanisms are positioned relative to each on the carrier assembly to enable the print medium to be selectively placed onto the carrier assembly;

aligning and orientating the non-conventional print medium onto the carrier assembly using the plurality of retaining mechanisms to facilitate printing upon the non-conventional print medium using a preformatted printing template selected from a conventional computer software printing application; and passing the carrier assembly including the print medium attached thereto through a printer.

* * * * *